US005806436A

United States Patent [19]

Weichenrieder, Sr. et al.

[11] Patent Number: 5,806,436

[45] Date of Patent: Sep. 15, 1998

[54] SHIPPING PALLET MADE OF PLASTIC

[76] Inventors: Erich Weichenrieder, Sr., Neukolbing 1, 82544 Egling; Erich K. Weichenrieder, Jr., Munchner Str. 5, 83624 Otterfing, both of Germany

[21] Appl. No.: 975,875

[22] Filed: Nov. 21, 1997

Related U.S. Application Data

[63] Continuation of Ser. No. 256,397, Dec. 14, 1997, abandoned.

[30] Foreign Application Priority Data

Nov. 10, 1992 [DE] Germany ..... 42 37 917.2

[51] Int. Cl.[6] ..... B65D 19/38

[52] U.S. Cl. ..... 108/57.23; 108/57.27

[58] Field of Search ..... 108/52.1, 57.17, 108/57.2, 57.23, 57.27, 57.33, 901

[56] References Cited

U.S. PATENT DOCUMENTS 5,117,762 6/1992 Shuert .

FOREIGN PATENT DOCUMENTS 2702450 9/1994 France ..... 108/52.1

*Primary Examiner*—Peter M. Cuomo
*Assistant Examiner*—Gerald A. Anderson
*Attorney, Agent, or Firm*—Kirkpatrick & Lockhart LLP

[57] ABSTRACT

On a shipping pallet made of plastic, with two parallel surfaces forming its upper side and its underside respectively, whereby each surface is the outside of the base of two basic components permanently connected to one another, the bases of which are located at some distance from one another, the base of each basic component is a closed plate. The space between the bases of the basic components is bridged by a pair of strips parallel to one another and enclosing a groove between them. On both ends of each pair of strips the groove is closed by a cross member connecting the two bases to form a chamber. The space between the bases along the circumference of the pallet is closed by edge strips. The pallet is provided with feet projecting outward from a surface, and equipped with skids if necessary, and the two basic components are tightly connected to one another in the vicinity of the strips and cross member.

14 Claims, 3 Drawing Sheets

Figure 5:
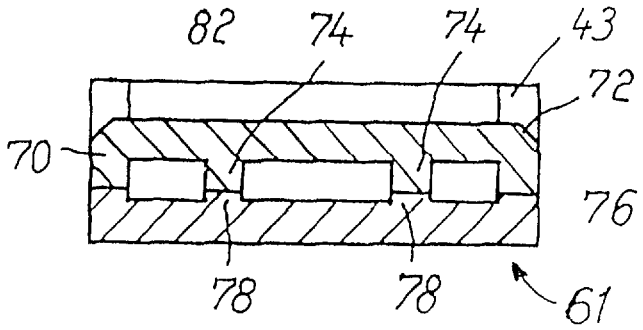

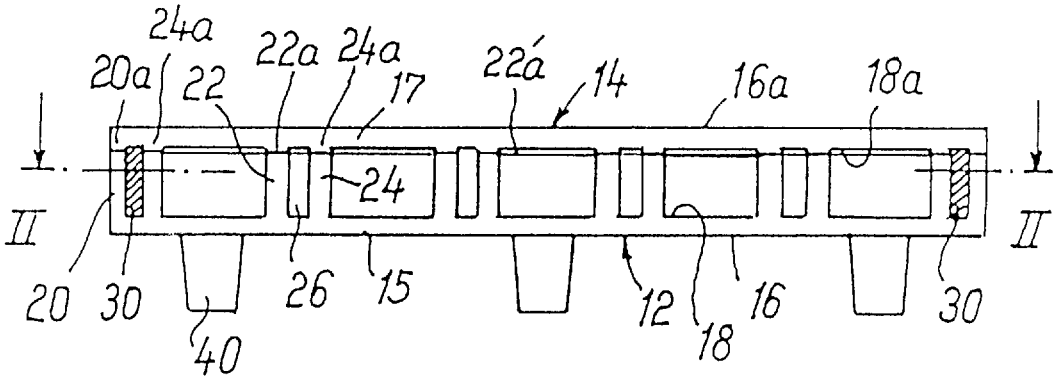
Fig. 1
Fig. 2
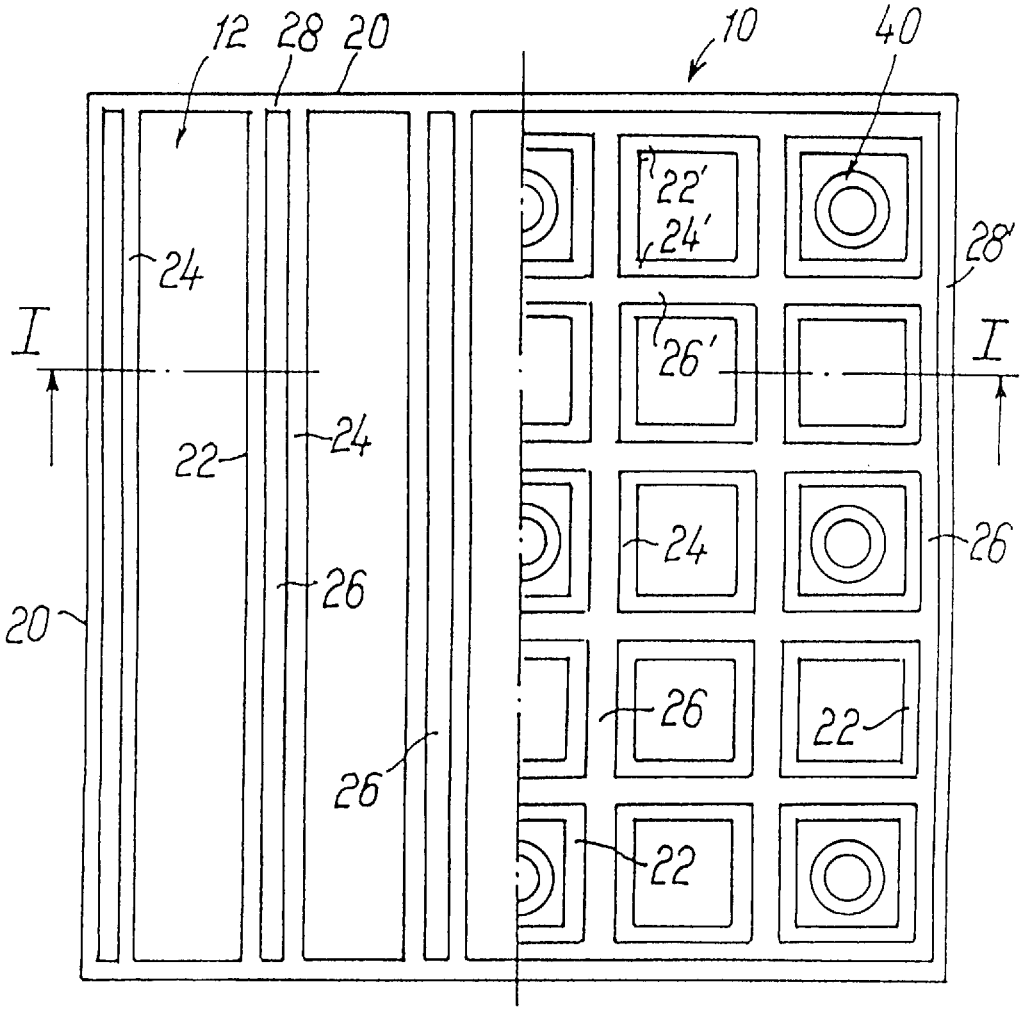

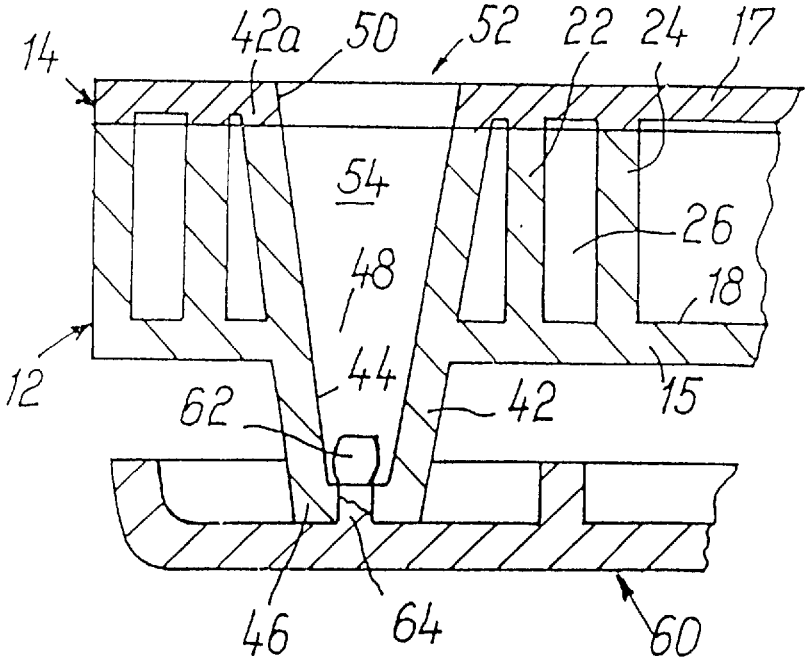
Fig. 3
Fig. 4
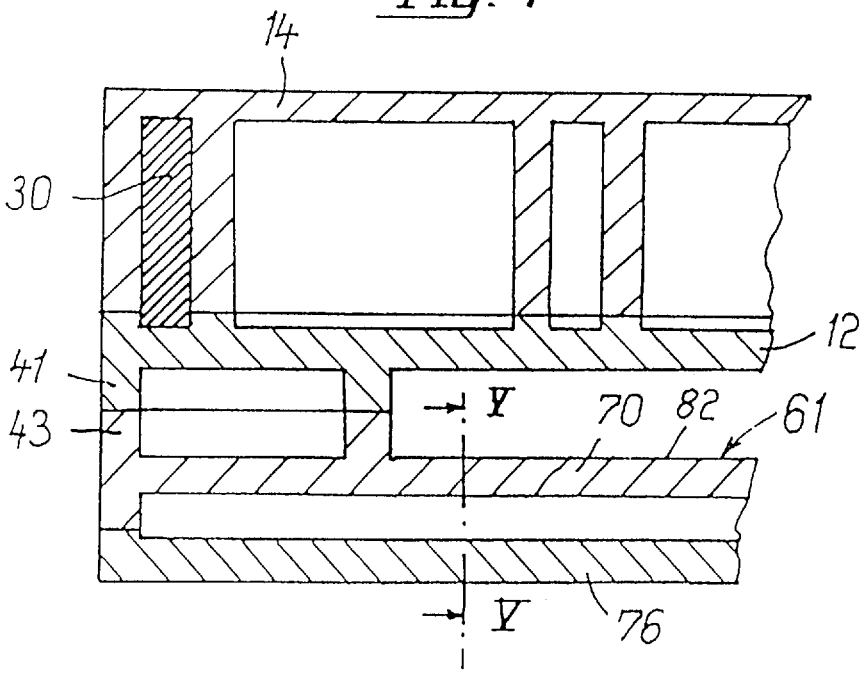

SHIPPING PALLET MADE OF PLASTIC

This application is a continuation of application Ser. No. 08/256,397 filed on Dec. 14, 1997 now abandoned.

This invention relates to a shipping pallet made of plastic, with two parallel surfaces forming its upper side and its lower side respectively, whereby each surface is the outside of the base of one of two basic components permanently connected to one another, the bases of which are located at a distance from one another.

A shipping pallet of this type is disclosed in DE-OS 26 55 593. To save plastic material, each base has a grid-like structure so that the upper and lower sides have a number of openings. Each basic component is provided with blocks located in the manner of pallet feet, which project beyond the space enclosed by the elements forming the grid toward the other basic component, and permanently connect the two basic components together to form the pallet. Between the two bases, a free space thus remains, which is intended for the engagement of the forks of a fork-lift truck. The elements forming the grid are ribbed, and the distance between them is less than the width of a fork element of the fork-lift truck, so that the penetration of the fork into the area of these ribs and the resulting possible damage is prevented.

Between the blocks of a basic component, reinforcement strips run, which are provided with open grooves into which removable, rigid reinforcement elements are inserted and are preferably locked or fixed in place. Thus, in spite of the fact that it yields savings in terms of plastic material, the pallet has a high load-carrying capacity.

This pallet of the prior art has a very complex shape, which interferes greatly with an effective cleaning. The pallet is quite high, and does not meet the requirement for the smallest, flattest pallet possible. The reinforcement elements are also exposed to the possible action of corrosive substances, so that their useful life is limited, unless they are made of particularly expensive material, e.g. high-grade steel.

Since pallets are being used to an increasing extent to transport foods and edible products, it must be possible to keep the pallets as clean and free of germs as possible by means of effective and still relatively simple cleaning methods which, to be effective, require the simplest and smoothest surfaces possible, on one hand to keep the deposits of dirt as small as possible, and on the other hand to allow the detergent to come into direct contact with all parts of the surface.

For general economic reasons, it must also be possible to manufacture the pallet as economically as possible, with a high load-carrying capacity and a long useful life, and to keep it as low as possible, which is important in particular for the return transport of empty pallets The object of the invention is therefore to design a pallet of the type described above so that it is as rigid as possible, has the greatest load-carrying capacity possible, has a long useful life and is therefore as free as possible of components which are susceptible to corrosion, so that it can be manufactured economically in large numbers, can be disposed of with no harm to the environment, and in particular so that it has a shape with largely smooth and closed surfaces which can be cleaned effectively.

The pallet must also be designed so that it can be manufactured from recycled plastic material, in particular also from unsorted household waste plastics processed merely by pressing, so that it contributes to the more efficient disposal of such plastic waste.

The invention teaches that this object can be achieved by means of the pallet described above, which is characterized by the fact that the base of each basic component is a closed plate, that the space between the bases of the basic components is bridged by pairs of strips parallel to one another which enclose a groove between them, that on both ends of each pair of strips, the groove is closed by a cross member connecting the two bases to form a chamber, that the space between the bases is closed along the circumference of the pallet by edge strips, that it is provided with feet which project outward beyond a surface, and that the two basic components are connected tightly to one another in the vicinity of the strips and cross members.

As a variation of the structure described above, the two basic components, after the connection, form a simply designed plate with smooth surfaces which is easy to clean and which, on account of its internal structure and the reinforcement inserts used as necessary, has a high load-carrying capacity in spite of a relatively low requirement for material, whereby the load-carrying capacity can be even further improved if necessary, by inserting a rigid reinforcement insert in at least one groove. In particular, on account of the reinforcement inserts, the dimensional stability of the pallets can be guaranteed, even if they are stored outdoors for long periods of time.

The plate overall can be kept relatively flat and thereby makes it possible to keep the pallet low. Because this plate is closed along its circumference, it cannot be damaged, even if improperly engaged by the fork of a fork-lift truck.

An advantageous embodiment of such a pallet can be manufactured economically from plastified plastic waste, in particular from unsorted household plastic waste. On account of its polyethylene component, this material is particularly strong, as well as tough, inelastic and resistant to breakage. On account of the potential inclusion of foreign matter or on account of fluctuations in the composition and thus variable melting points, it can only be processed in a pressing process.

One, some or all of the externally sealed chambers formed in the pallet claimed by the invention can be provided with reinforcement inserts, as a function of the load expected, before the two basic components are connected to one another, preferably by vibration welding or sealing with heat reflectors. Because the reinforcement inserts are tightly enclosed in the chambers, and also because the moisture in the chambers is reduced during the welding or sealing process, there is no risk of corrosion for reinforcements made of metal, so that inexpensive alloys can be used. In connection with the use of a plastic material which is both economical and still very strong, it is therefore possible to use relatively aggressive cleaning agents.

The length of the reinforcement insert is preferably selected taking into consideration the changes in the length of the pallet caused by changes in temperature on one hand, and changes in the length of the reinforcement insert on the other hand, so that even with the maximum limit temperatures to be expected, there is no reason to fear any disruptive effects.

The pallets can be manufactured easily if, as in one advantageous embodiment, the strips, cross members and edge strips have the same height with respect to the base of a basic component. Preferably, strips, crossbars and edge strips which coincide with one another are located on both basic components of the element, whereby the height of the strips, cross members and edge strips of the one basic component corresponds approximately to the distance between the two basic components which form the element, while the height of the strips, cross members and edge strips, if any, of the other basic component is limited to the height of welding lugs, so that before the two basic components are connected to one another, the reinforcement strips can be embedded completely in the grooves formed between the pairs of strips.

For the strength of the pallet, it has been found to be favorable if, as in one preferred configuration, the basic component which has the strips, cross members and edge strips at approximately the distance between the bases of the basic components is provided with the feet.

In an additional favorable configuration which simplifies the manufacturing process, all the strips in a group of pairs of strips parallel to one another are oriented parallel to one another. The element can thereby comprise two groups of pairs of strips parallel to one another, whereby the direction of the strips of the one group intersects the direction of the strips of the other group, and in the area of the intersection of each pair of strips of the one group with a pair of strips of the other group, the strips are interrupted so that the grooves enclosed by all the pairs of strips are in communication with one another.

Preferably, in this case for pallets with a high load-carrying capacity, a grid-like, rigid reinforcement insert is inserted in the grooves which are in communication with one another.

The feet are preferably designed as hollow bodies, and are located in an area which is kept free of the pairs of strips, whereby their cross section tapers continuously toward their free ends, and the surface of the pallet facing away from the feet has an opening opposite each of the feet which is suitable for the insertion of a foot, whereby the cavity enclosed by the feet opens toward this opening, and whereby the area between the opening and the basic component which has the foot is enclosed with a wall which is sealed tightly to both bases, the inner wall surface of which fits flush into the inner wall surface of the foot.

The feet are advantageously molded onto the adjacent basic component.

In one advantageous embodiment, the free ends of the feet and skids which are sized to the distance to be bridged between two feet are provided with corresponding connecting elements, so that the pallet can be provided underneath the feet with at least two skids parallel to one another.

In a first variant, the skids can be detachably connected to the feet, but in a preferred variant, the pallet and skids form an inseparable unit.

In one advantageous embodiment, the skids consist of a bucket-like top part which is connected to the feet and is open on the bottom, and a lower part which covers this opening and is connected to the upper part to form a hollow body. The upper part is preferably bevelled on its longitudinal edges facing the feet to facilitate the insertion of lift forks.

In a particularly advantageous embodiment, the skids are divided into chambers by longitudinal ribs formed on the upper part, whereby at least one of the chambers can contain a rigid reinforcement insert which is enclosed by the sealed connection between the top part of the skid and the bottom part of the skid in a chamber where it is protected against corrosion.

In one advantageous configuration, the bottom part is designed as a flat cover which has welding lugs which correspond to the edges of the top part and correspond to its longitudinal ribs, if any.

To realize the pallet and skids as an inseparable unit, in one appropriate embodiment, the feet are molded onto the underside of the pallet as frames which are open on the bottom, with corresponding frames on the skids, and the frames corresponding to one another on the underside and on the skids are welded to one another, thereby forming a sealed cavity.

In an additional preferred embodiment, the pair of strips extend completely across the pallet.

The invention is explained below in greater detail, with reference to the embodiments illustrated in the accompanying drawings.

Figure 6:
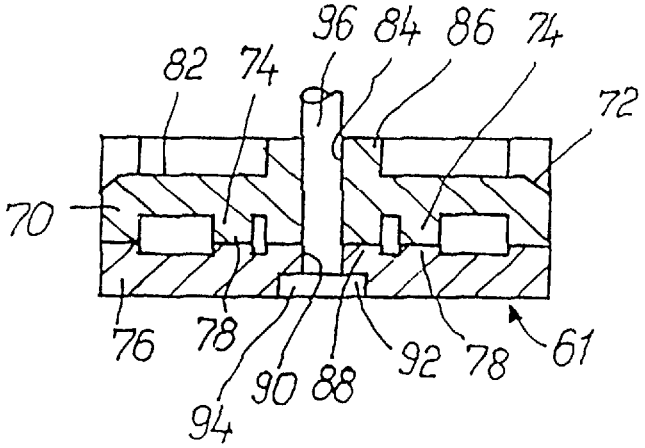

FIG. 1 shows a cross section through a transport pallet along Line I—I in FIG. 2, FIG. 2 shows a section along Line II—II in FIG. 1, whereby the right and left sides show two different embodiments of the peripheral area, FIG. 3 shows a cross section which corresponds to FIG. 1, in a peripheral area of the pallet provided with a foot, FIG. 4 shows a cross section as in FIG. 2 through another embodiment of the pallet with permanently attached skids, FIG. 5 shows a cross section along Line V—V in FIG. 4, and FIG. 6 shows a cross section through a skid as in FIG. 5 on a variant with a skid fastening in the manner of an expansion anchor.

The illustrated pallet, which in general is designated 10, consists essentially of two basic components 12 and 14 produced by pressing plastified household plastic waste, which are permanently connected to one another, preferably by sealing with heat reflectors.

The basic component 12 consists of a rectangular, plate-shaped base 15, one side 16 of which forms an outside of the element 10. On the side 18 facing away from the side 15, an edge strip 20 extends at right angles to the plane of the plate along the circumference of the plate. Between two opposite segments of the edge strip 20, strips 22 and 24 run parallel to one another in pairs, and between them they enclose a groove 26. On the example illustrated in the left half of FIG. 2, all the strips 22 and 24 run parallel to two parallel lateral edges of the base 15. In this case, grooves 26 can also be located directly in the peripheral area of the base 15 by means of strips 24 and 22 which correspond to the width of the grooves 26 adjacent to the edge strips 20 parallel to the strips 22 and 24. This configuration is also possible if, as in the variant illustrated in the right half of FIG. 2, a second group of strips 22' and 24' is added to the first group of strips 22 and 24, and run at right angles to the strips 22 and 24 of the first group. In this case, the strips 22 and 24 or 22' and 24' are each interrupted in the area of the intersection of the two groups of strips so that the grooves 26 and 26' are in communication with one another.

Instead of running parallel to the edges of the base 15, the ribs 22 and 24 or 22' and 24' can also run diagonally with respect to the edges, and if necessary also at an acute angle to one another, so that the grooves 26 and 26' form a checkerboard pattern.

Where the grooves 26 and 26' encounter the edge strips 20, the segment of the edge strip 20 which intersects the groove 26 or 26' forms a web 28 or 28' which closes each groove 26 or 26'.

The basic component 14 likewise consists of a rectangular, plate-shaped base 17, with a side 16*a* forming one outside surface of the pallet 10 and a side 18*a* facing the side 18 of the base 15, which is designed to coincide with the side 18, i.e. it is provided with profiles 10*a*, 22*a*, 24*a*, 22'*a* and 24'*a* corresponding to the edge strips 20 and the strips 22 and 24 or 22' and 24'. But the height of these profiles, on account of their function as welding lugs, is relatively low, while the height of the edge strips 20 and of the strips 22, 24, 22' and 24' corresponds approximately to the distance between the sides 18 and 18*a* opposite one another of the finished pallet 10.

Before the two basic components 12 and 14 are connected to one another to form the pallet 10, metal reinforcement inserts 30 can be inserted in one or more or all of the grooves 26 and/or 26' to reinforce the pallet 10, as a function of the desired stability and load-carrying capacity. If there are two groups of grooves 26 and 26', a grid-like structure which matches the overall system of grooves 26 and 26' can also be used as the reinforcement insert.

By careful sealing of the basic components 12 and 14, the grooves are closed to form moisture-tight chambers into which the reinforcement inserts 30 are introduced and where they are protected against corrosion.

In a configuration which is conventional on pallets, three rows of three feet 40 each are provided on the underside of the pallet, whereby these feet are molded on the bottom basic component 12 and are tapered toward their free end. The feet 40 are hollow and are formed by a surface 42 in the shape of a truncated cone or a truncated pyramid with an inner wall surface 44 which, on its free end, is closed by a bottom 46. The surface 42 is connected to the base 15 of the basic component 12, whereby the ribs 22 and 24 on the base 15 are distributed so that the areas where the feet 40 are located are free of ribs, so that it becomes possible to stack empty pallets in a particularly space-saving manner, as described below.

The base 15 is penetrated by the surface 42 molded on it in the vicinity of an opening 48 made in it, whereby the surface 42, continues on the inside 18 of the base 15 and ends in the plane defined by the height of the ribs 20, 22 and 24. Retaining the acute angle selected for the inner wall surface 44 of the surface 42, this wall surface 44 is therefore continued in the inside of the hollow loading pallet 10. On the upper basic component 14, the base 17 is provided on its inner side 18*a* with a welding lug 42*a* which corresponds to the exposed end of the surface 42 on the basic component 12. The welding lug 42 is designed so that after the welding of the two basic components 12 and 14, it has an inner wall surface 50 which is flush with the inner wall surface 44, and empties in a hole 42 in the base 17. After the welding of the two basic components 12 and 14, the pallet 10 thus has openings formed by the openings 52 on its upper side 16, which are adjoined by a cavity 54 bounded by the wall surfaces 44 and 50, which is suitable for holding a corresponding foot 40 of a pallet of the same type stacked on top of the pallet 10. The area provided for holding the reinforcement inserts 30 inside the hollow pallet 10 is tightly sealed with respect to the cavity 54.

To be able to move the pallets 10, it is possible to provide them in the manner of the prior art with skids 60 located under the feet 40. If it is desirable to use the pallets 10 with or without skids, there can be a detachable connection between the skids and the pallet, as illustrated in FIG. 3 or FIG. 5. Preferably, however, the skids are permanently connected to the pallet, as illustrated in FIG. 4.

FIG. 3 illustrates the skids 60, which like the pallet 10 are manufactured using a pressing process, and the skids have snap-in pins 62 corresponding to the feet 40 with a cross section shape which is convexly curved outward in longitudinal section, so that by pressing the snap-in pins 62 into openings 64 on the bottom 46 of each foot 40, the skids 60 can be permanently connected to a series of three feet 40.

An advantageous skid shape is illustrated in FIGS. 4, 5 and 6, where the skid 61 is designed as a hollow body. This hollow body consists of an upper part 70, which has approximately the shape of a bucket open on the bottom, whereby the upper longitudinal edges 72 facing the pallet 10 of the upper part 70 are bevelled, to facilitate the insertion of a forklift fork. Two longitudinal rubs 74, for example, run through the upper part 70 in the longitudinal direction. To form a closed hollow body, the opening of the upper part is preferably closed with a flat cover 76 by sealing with heat reflectors. The welding lugs 78 corresponding to the edges of the top part 70 and the ribs 74 are molded onto the cover 76 so that, as in the manufacture of the pallet 10, a moisture-tight cavity is formed which is divided into several chambers, in which metal reinforcement inserts can be placed before the basic components are sealed together, if necessary.

The skid 61 can also be detachably connected to the pallet 10. FIG. 6 illustrates one embodiment suitable for this purpose. The top part 70 is thereby provided on its upper side 82 with openings 84 which represent the opening of cylindrical guide sleeves 86 molded onto the inside of the top part 70, corresponding to which there are welding lugs 88 and passages 90 on the cover 76. On the underside of the cover 76, concentric to the passages 90, there are depressions 92, which are suitable for a countersunk installation of the heads 94 of connecting bolts 96, e.g. in the form of expansion anchors, to make it possible to connect the skids 61 to the feet 40.

In one preferred embodiment, however, the skids 61 are welded permanently to the pallets 10, for which purpose frame-like stubs 41 are molded onto the lower basic component 12, and corresponding to which, on the upper side 82 of the top parts 70 of the skids 61, there are corresponding counterparts 43, which can be connected, preferably by heat-reflecting sealing, to form a closed hollow body which forms a connecting foot between the pallet 10 and the skid 61.

We claim:

1. A plastic pallet, comprising:

a first basic component having a first rectangular base plate, said first base plate having an inner surface and an outer surface, said first basic component having a first edge strip surrounding said first base plate along its periphery and a first plurality of strips oriented in parallel to one another and projecting perpendicularly from said inner surface of said first base plate, said first plurality of strips and said first edge strip having approximate heights of welding lugs;

a second basic component having a second rectangular base plate, said second base plate having an inner surface and an outer surface, said second basic component having a second edge strip surrounding said second base plate along its periphery and a second plurality of strips oriented in parallel to one another and projecting perpendicularly from said inner surface of said second base plate, said first plurality of strips and said second plurality of strips are welded together, said first edge strip and said second edge strip are welded together, said second plurality of strips and said second edge strips having approximate heights corresponding to the distance between said inner surface of said first base plate and said inner surface of said second base plate, and wherein a plurality of closed chambers are formed between said inner surface of said first base plate and said inner surface of said second base plate;

at least one reinforcement element located in at least one of said chambers, said reinforcement element being entirely enclosed in said plastic pallet, and wherein said reinforcement element is inserted into said chamber prior to welds being made between said first plurality of strips and said second plurality of strips and between said first edge strip and said second edge strip; and a plurality of feet projecting from said outer surface of said second base plate.

2. The plastic pallet of claim 1 wherein said feet extend through a plurality openings in said second rectangular base plate and contact said inner surface of said first rectangular base plate.

3. The plastic pallet of claim 1 wherein said first plurality of strips and said second plurality of strips are oriented in parallel to one another.

4. The plastic pallet of claim 1 additionally comprising:

a third plurality of strips extending perpendicularly from said inner surface of said first base plate, said strips oriented in parallel to one another and perpendicular to said first plurality of strips, and wherein said third plurality of strips and said first plurality of strips have interruptions forming a first plurality of contiguous and perpendicular grooves; and a fourth plurality of strips extending perpendicularly from said inner surface of said second base plate, said strips oriented in parallel to one another and perpendicular to said second plurality of strips, and wherein said fourth plurality of strips and said second plurality of strips have interruptions forming a second plurality of contiguous and perpendicular grooves.

5. The plastic pallet of claim 4 further comprising a rigid, grid-like reinforcement insert located in said first and second pluralities of grooves.

6. The plastic pallet of claim 4 wherein said third plurality of strips and said fourth plurality of strips are oriented in parallel to one another.

7. The plastic pallet of claim 4 wherein said first plurality of strips and said second plurality of strips are oriented in parallel to one another.

8. The plastic pallet of claim 4 further comprising at least two skids, each skid connected to at least two of said feet at ends of said feet distal from said outer surface of said second rectangular base plate, said skids oriented in parallel to one another.

9. The plastic pallet of claim 8 wherein each of said skids has a bucket-like top portion connected to said feet and open toward the bottom of said skid, and wherein each of said skids has a bottom portion which covers said open portion of said top portion, said bottom portion connected to said top portion such that a hollow body is found in each of said skids.

10. The plastic pallet of claim 9 wherein said top portion of each of said skids is beveled on its longitudinal edges facing said feet.

11. The plastic pallet of claim 9 wherein each of said skids has a plurality of longitudinal ribs located in said top portion, said longitudinal ribs forming a plurality of chambers in said skids.

12. The plastic pallet of claim 9 wherein said bottom portion of each of said skids is a flat cover, said bottom portion having welding lugs connected to said top portion of said skids.

13. The plastic pallet of claim 12 further comprising at least one rigid reinforcement insert located in at least one of said chambers.

14. The plastic pallet of claim 9 wherein said feet are molded as frames, said feet being open on an end distal said outer surface of said second base plate, said skids have molded frames, and wherein said frames of said feet are connected to said frames of said skids to form a sealed cavity.

* * * * *